US012017843B2

(12) United States Patent
Bouchard-Amyotte

(10) Patent No.: US 12,017,843 B2
(45) Date of Patent: Jun. 25, 2024

(54) ARTIFICIAL TREE AND METHODS FOR PACKING THEREOF

(71) Applicant: 6646158 Canada Inc., Lasalle (CA)

(72) Inventor: Alexis Bouchard-Amyotte, Lachine (CA)

( * ) Notice: Subject to any disclaimer, the term of this patent is extended or adjusted under 35 U.S.C. 154(b) by 34 days.

(21) Appl. No.: 17/547,473

(22) Filed: Dec. 10, 2021

(65) Prior Publication Data

US 2022/0185575 A1 Jun. 16, 2022

Related U.S. Application Data

(60) Provisional application No. 63/124,301, filed on Dec. 11, 2020.

(51) Int. Cl.

| | |
|---|---|
| ***A47G 33/12*** | (2006.01) |
| ***A47G 33/06*** | (2006.01) |
| ***B65D 85/64*** | (2006.01) |

(52) U.S. Cl.

CPC ..... *B65D 85/64* (2013.01); *A47G 33/06* (2013.01); *A47G 33/12* (2013.01); *A47G 2033/1233* (2013.01)

(58) Field of Classification Search

CPC ..... B65D 85/64; A47G 33/06; A47G 33/12; A47G 2033/1233

See application file for complete search history.

(56) References Cited

U.S. PATENT DOCUMENTS

| | | | | |
|---|---|---|---|---|
| 1,150,708 A | | 8/1915 | Schlecht | |
| 3,003,623 A | | 5/1959 | Paul et al. | |
| 3,973,356 A | | 8/1976 | Schacht | |
| 4,072,857 A | * | 2/1978 | DeVicaris | F21S 8/035 362/431 |
| 4,662,107 A | | 5/1987 | Van Den Kieboom | |
| 5,256,461 A | | 10/1993 | Johnson | |
| 8,985,329 B2 | | 3/2015 | Ullrich | |

(Continued)

FOREIGN PATENT DOCUMENTS

| | | | |
|---|---|---|---|
| CN | 205951587 U | * | 2/2017 |
| DE | 631054 C | | 6/1936 |

(Continued)

OTHER PUBLICATIONS

Amazon, "Lego 3-Drawer Storage Rack System", Jun. 30, 2019 (Date first available), accessed online Mar. 9, 2023 at Amazon.com/LEGO-40950002-3-Drawer-Storage-Rack-Blue (Year: 2019).*

(Continued)

*Primary Examiner* — Kim S. Horger

(74) *Attorney, Agent, or Firm* — Anglehart et al.

(57) ABSTRACT

An artificial tree; it has a hollow receptacle for presentation as a decorative tree container; a core support; and branches connected or connectable to the core support, wherein the core support is connectable to the hollow receptacle and the branches are connected to the core support when the tree artificial tree is assembled for displaying the branches over the hollow receptacle, and wherein a hollow interior of the hollow receptacle is dimensioned to receive and store the branches and the core support therein when the artificial tree is disassembled, for at least one of storage and transportation of the disassembled artificial tree.

10 Claims, 7 Drawing Sheets

(56) References Cited

U.S. PATENT DOCUMENTS

| | | | | |
|---|---|---|---|---|
| 9,657,491 | B1 * | 5/2017 | Mansueto | A47G 33/12 |
| 2005/0138862 | A1 | 6/2005 | O'Connor | |
| 2010/0213090 | A1 | 8/2010 | Bebrin et al. | |
| 2011/0076425 | A1 * | 3/2011 | Cheng | F21S 4/10 428/8 |
| 2018/0362213 | A1 | 12/2018 | Van Den Kieboom et al. | |
| 2020/0121109 | A1 | 4/2020 | Chapman, Jr. | |
| 2020/0290795 | A1 | 9/2020 | Freilich et al. | |

FOREIGN PATENT DOCUMENTS

| | | | | |
|---|---|---|---|---|
| EP | 0240628 | A1 | 10/1987 | |
| GB | 2035789 | A1 | 6/1980 | |
| GB | 2518374 | A * | 3/2015 | A47G 33/06 |
| WO | 1999/067157 | A1 | 12/1999 | |
| WO | 2001/058783 | A1 | 8/2001 | |

OTHER PUBLICATIONS

LEGO, "Christmas Tree", 2019, accessed online Mar. 9, 2023 at lego.com/en-us/service/buildinginstructions/search?q=40338 (Year: 2019).*

* cited by examiner

ARTIFICIAL TREE AND METHODS FOR PACKING THEREOF

The present application claims priority from U.S. provisional patent application No. 63/124,301, filed on Dec. 11, 2020, incorporated herein by reference.

FIELD OF THE INVENTION

The present disclosure relates to an artificial tree, and more particularly to methods of packing the artificial tree.

BACKGROUND

Nowadays, artificial trees, including artificial plants and bushes, are widely used for creating indoor or outdoor installations. There is everything in the art from small plants to large trees, such as palm trees or Christmas trees. Most people are familiar with artificial Christmas trees used for decorating their homes, a ground near their home, public zones, etc.

Many of available artificial Christmas trees are not integrally formed and need to be assembled to install them for their intended use or disassembled to pack and transport them from one installation place to another installation place. However, most artificial Christmas trees known in the art are difficult to assemble and take too much space when dissembled for storage or packed for transportation. This is also true for many large decorations, such as for large figurines or sculptures.

An illustrative example of the artificial Christmas tree is disclosed in US 20200290795. However, the artificial Christmas tree of US 20200290795 has the same disadvantage as most of the artificial Christmas trees known in the art; in particular, the artificial takes too much space when packed for transportation or storage.

Therefore, in view of the above, an important concern in the art is developing an artificial tree having an improved structure allowing: a retailer/distributor to improve freight efficiency, a user to easily disassemble the artificial tree and compactly pack the disassembled artificial tree for storage.

SUMMARY

It is an object of the present teachings to provide an improved modular decoration structure, such as that for an artificial tree, facilitating the assembling/disassembling of the modular decoration (e.g. artificial tree) and simplifying the packing of the disassembled modular decoration (e.g. disassembled artificial tree) in a space-saving manner.

Reference is made to an artificial tree as an exemplary modular decoration for purposes of illustration. Namely, the artificial tree of the present disclosure employs the decorative container of the artificial tree (the portion that acts as a container or pot), provided with a hollow interior, to receive and hold all of the other components of the artificial tree for the purpose of storage and/or transportation (e.g. shipping). As such, an artificial tree, when disassembled, may be provided in a smaller, compact form, the form defined by the shape of the container or hollow receptacle (as all of the other disassembled components are contained therein), for the purpose of storage and/or transportation. When the container with the disassembled components of the artificial tree are to be assembled into the artificial tree, the other components (e.g. branches; core support) may be removed from the container, the core support connected to the container that acts as the base of the artificial tree, where the tree container can provide the artificial tree with extra height (adding to the size or imposing quality of the artificial tree). It will be understood that in the case of a natural tree, the container is usually filed with soil, the roots of the tree mingled with the soil and also contained in the container. Moreover, the container is one for display, and as such may have a certain finish, ornamentation, pattern, etc., for the purpose of being decorative. As such, the container of the present disclosure imitates the decorative container of a real tree, as it will be understood that the container of the present disclosure does not have to contain soil or roots, the tree being artificial.

A broad aspect of the present disclosure is a modular decoration, including a hollow receptacle acting as a decorative base; modules assembling into a decorative top;

and wherein at least one of the modules is connectable to the hollow receptacle and the modules are attached to one another to result in the decorative top, and wherein a hollow interior of the hollow receptacle is dimensioned to receive and store the modules when the modular decoration is disassembled, for at least one of storage and transportation of the disassembled modular decoration.

In some embodiments, the modular decoration may be a figurine with a base, the hollow receptacle may be for presentation as the decorative base, and the modules may represent body parts of the figurine.

In some embodiments, the modular decoration may be an artificial tree, the hollow receptacle may be for presentation as a decorative tree container, the modules may include a core support and branches, wherein one of the branches are permanently connected to the core support and the core support is composed of a plurality of segments; and the branches are connectable to the core support during assembly of the artificial tree and can be disconnected from the core support during disassembly of the artificial tree; and the at least one module is the core support.

A broad aspect is an artificial tree. The artificial tree includes a hollow receptacle for presentation as a decorative tree container; a core support; and branches, wherein one of the branches are permanently connected to the core support and the core support is composed of a plurality of segments; and the branches are connectable to the core support during assembly of the artificial tree and can be disconnected from the core support during disassembly of the artificial tree; and wherein the core support is connectable to the hollow receptacle and the branches are connected to the core support when the tree artificial tree is assembled for displaying the branches over the hollow receptacle, and wherein a hollow interior of the hollow receptacle is dimensioned to receive and store the branches and the core support therein when the artificial tree is disassembled, for at least one of storage and transportation of the disassembled artificial tree.

In some embodiments, the core support may be connectable to the base of the hollow receptacle.

In some embodiments, the core support may include a trunk portion that is integral to the core support or connectable to a rest of the core support, the trunk portion forming an artificial tree trunk of the artificial tree that protruded vertically from the hollow receptacle when the artificial tree is assembled.

In some embodiments, the trunk portion may be composed of interconnected trunk members.

In some embodiments, the interconnected trunk members may include the branches.

In some embodiments, the core support may be provided with a spacer mounted thereon such that the spacer bears or closely bears against an inner surface of the hollow receptacle.

In some embodiments, the space may be disk-shaped.

In some embodiments, the branches may be pliable in order to adapt a shape of a crown of the artificial tree.

In some embodiments, the hollow interior of the hollow receptacle may be dimensioned to receive the branches and the core support once the branches are disconnected from the core support.

Another broad aspect is a method of packing the artificial tree as herein, including detaching a core support, connected or connectable to branches of the artificial tree, from the hollow receptacle; and placing the core support and the branches, connected to the core support or disconnected from the core support, inside the hollow interior of the hollow receptacle for at least one of storage and transportation.

In some embodiments, the method may include, after the placing, covering an opening of the hollow interior of the hollow receptacle for closing the hollow interior of the hollow receptacle.

Another broad aspect is a method of packing an artificial tree for at least one of storage and transportation. The method includes placing a core support of the artificial tree for supporting branches of the artificial tree, and the branches in a hollow interior of a hollow receptacle, the hollow receptacle serving as a packing vessel for the at least one of storage and transportation, and the hollow receptacle acting as a decorative container of the artificial tree for displaying the artificial tree once the artificial tree is assembled by having the core support connect to the hollow receptacle, supporting the branches appearing outside of the hollow receptacle when the artificial tree is assembled.

In some embodiments, the core support may include trunk members for representing a tree trunk, the trunk members interconnecting to one another to constitute an artificial trunk when the artificial tree is assembled.

In some embodiments, the method may include placing a spacer into the hollow interior of the hollow receptacle, the spacer bearing or closely bearing against an inner surface of the hollow receptacle when the artificial tree is assembled.

In some embodiments, the branches may be disconnected from the core support when placed in the hollow interior of the hollow receptacle.

In some embodiments, the branches may be connected to the core support when placed in the hollow interior of the hollow receptacle.

In some embodiments, the method may include, after the placing, closing an opening of the hollow interior of the hollow receptacle.

Another broad aspect is a method of unpacking and assembling an artificial tree for displaying the artificial tree in a hollow receptacle acting of the artificial tree as a decorative tree container, comprising, from the hollow receptacle acting as a vessel for storage, removing a core support and branches of the artificial tree; and joining the core support to the hollow receptacle, wherein the branches are connected to the core support, the branches displayed above the hollow receptacle, supported by the core support, and wherein the hollow receptacle acts as the decorative container of the artificial tree.

In some embodiments, the core support may include trunk members that are interconnectable to result in an artificial trunk, the branches connected to the artificial trunk.

In some embodiments, the method may include, from the hollow receptacle acting as a vessel for storing the artificial tree, removing a spacer, wherein, after the joining the core support to a base of the hollow receptacle, the spacer bears or closely bears against an inner surface of the hollow receptacle to support the core support with the connected branches.

BRIEF DESCRIPTION OF THE DRAWINGS

The invention will be better understood by way of the following detailed description of embodiments of the invention with reference to the appended drawings, in which.

DETAILED DESCRIPTION OF THE INVENTION

Figure 1:
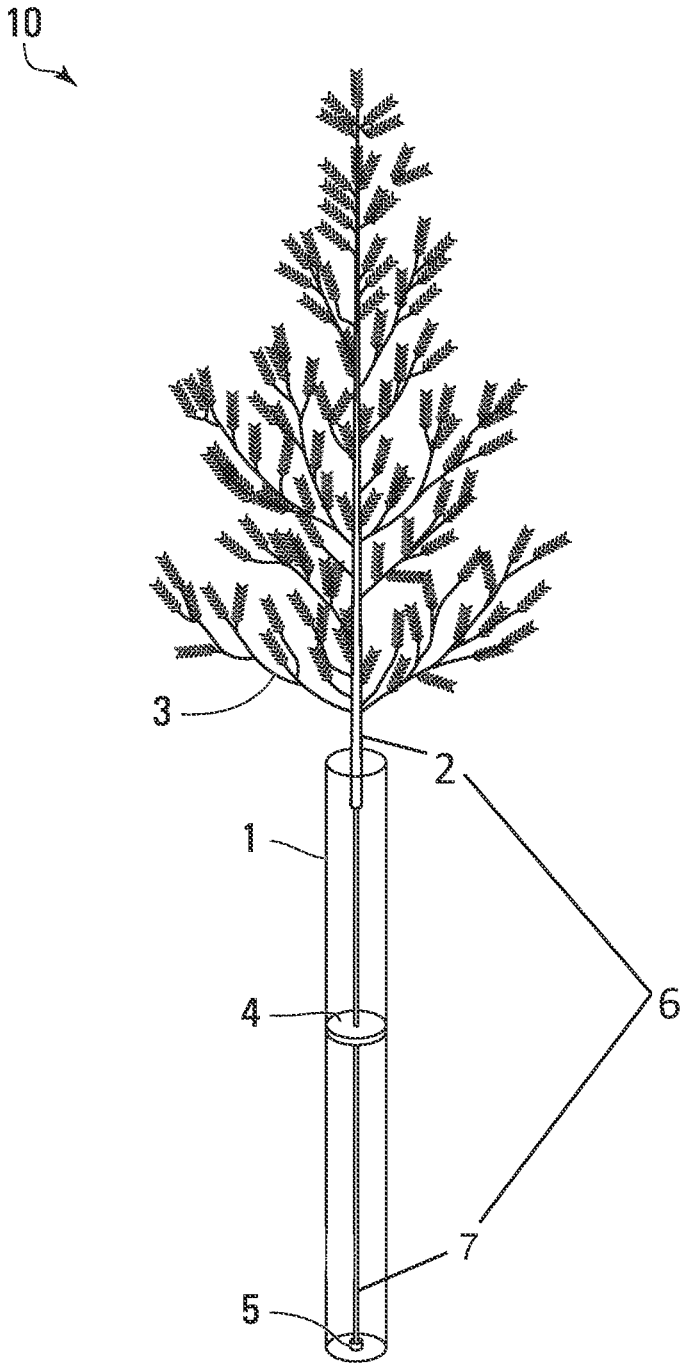
FIG. 1 schematically illustrates a general view of an artificial tree of the present teachings.

While this invention is susceptible to embodiments in many different forms, there is shown in the drawings, and will herein be described in detail, specific embodiments with the understanding that the present disclosure of such embodiments is to be considered an example of the present principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

Definitions:

The terms “a” or “an”, as used herein, are defined as one or as more than one. The term “plurality”, as used herein, is defined as two or as more than two. The term “another”, as used herein, is defined as at least a second or more. The terms “including” and/or “having”, as used herein, are defined as comprising (i.e., open language). The term “connected” and/or “interconnected”, as used herein, are defined as interacted, although not necessarily directly, and not necessarily mechanically (in particular, the term “connected” may be defined as interacted indirectly through at least one intermediate component).

Reference throughout this document to “an embodiment”, “one embodiment”, “another embodiment” “some embodiments”, “other embodiments”, or similar terms means that a particular feature, structure, or characteristic described in connection with the embodiment is included in at least one embodiment of the present invention. Thus, the appearances of such phrases in various places throughout this specification are not necessarily all referring to the same embodiment and may refer to any relevant embodiments as defined herein. In other words, the particular features, structures, or characteristics may be combined in any suitable manner in one or more embodiments without any limitation.

The term "or", as used herein, is to be interpreted as an inclusive term or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The term "means" preceding a present participle of an operation indicates a desired function for which there is one or more embodiments, i.e., one or more methods, devices, or apparatuses for achieving the desired function, and that one skilled in the art could select from these or their equivalent in view of the disclosure herein, and use of the term "means" is not intended to be limiting.

The drawings featured in the figures are for the purpose of illustrating certain convenient embodiments of the present invention and are not to be considered limiting thereto.

As used herein, the term "artificial tree" refers to a constructed object made of synthetic and/or artificial materials, designed to resemble a real tree (e.g. a fir or pine of any known type, palm tree, etc.), or the like. The crown of the tree may have any predetermined shape, such as a globe, a cone, etc. In one embodiment, all the materials used for producing the artificial tree are synthetic. However, in some other embodiments, the tree may be partly made of an artificial material, and may be partly made from natural or real materials, used for producing at least a part of the artificial three (e.g. at least some of needles glued or secured to tree branches and/or tree branches attached or connected to a tree trunk may be natural or real).

As used herein, the term "modular decoration" refers to a decoration that is assembled by piecing together the different modules, preferably resulting in generating height when assembled together through at least some vertical assembly, resulting in the completed decoration. The modules of the modular decoration include a module that is a receptacle that can act as a container for storage into which the other modules of the modular decoration may be added, and the container also serving as a base onto which the other modules of the modular decoration are assembled. For instance, the modular decoration may be an artificial tree or artificial cactus, where the receptacle acts as a decorative container, and the other modules of the modular decoration form the trunk and branches of the tree. In another example, the modular decoration may be a life-size figuring, e.g. of Santa Claus, where the receptacle acts as a stand onto which Santa Claus is placed, the other modules of the modular decoration fitting together to result in Santa Claus. In yet another example, the modular decoration may be for an abstract sculpture, where the receptacle acts as the pedestal for the sculpture, and the other modules of the modular decoration form the sculpture. In some examples, one of the modules may be a shaped material such as a synthetic material (e.g. nylon, polyvinyl chloride, etc.) that can receive air and take its shape when inflated with air, or that expands when inflated with air (e.g. a balloon), thereby providing added verticality to the structure once inflated, resulting in an inflatable figure such as an inflatable snowman, an inflatable pumpkin, and inflatable Grim Reaper, an inflatable rabbit, etc. The air may also be used to generate a current of air that travels through the material of the module, giving the fabric shape and verticality, such as an inflatable tube man dancer, etc.

As used herein, the term "tree trunk" refers to a trunk of the tree, may the tree be artificial or natural.

The following exemplary embodiments of the present teachings are provided for an artificial Christmas tree. However, it will be understood that the present disclosure is not limited to an artificial Christmas tree, and may relate to any other artificial tree (e.g. palm tree; maple tree; etc.) without departing from the present teachings.

Now referring to the drawings, FIG. 1 is a modular decoration that is, for illustrative purposes, an artificial tree 10 according to one embodiment of the present teachings, wherein a structure of the tree 10 is comprised of a plurality of interconnectable structural members or elements adapted to be releasably attached or connected to each other in an appropriate manner to resemble a real fir or pine. For purposes of illustration, the modular decoration of FIG. 1 is an artificial tree. However, it will be understood that the modular decoration be another kind of modular decoration, such as a large figurine (where the receptacle 1 acts as a stand for the figurine, where the receptacle can be flipped such that the figurine is footed on the base of the receptacle), a sculpture (where the receptacle 1 acts as a pedestal for the sculpture, where the receptacle can be flipped such that the sculpture is anchored to the base of the receptacle), in accordance with the present teachings.

The artificial tree 10 of FIG. 1 has a hollow receptacle 1 formed as a container or a pot for the tree, the receptacle 1 serving as a tree support. As shown in FIG. 1, the hollow interior of the receptacle 1 is substantially cylindrically shaped and defined by a bottom and sidewalls of the receptacle 1. In an embodiment, the hollow interior of the receptacle 1 may have any suitable shape for placing or inserting the structural members of the artificial tree 10 into the hollow interior when the structural members are disconnected from each other (see FIG. 2). The hollow receptacle 1 may have an elongated shape in order to provide sufficient space for receiving the constituent parts of the trunk 2 and the branches 3, as explained herein.

The artificial tree 10 also has a core support 6 which may include a tree trunk portion 2 composed, in some examples, with interconnectable trunk members (not shown). Generally, the core support 6 is formed as a rigid tubular element or tube. The core support 6 may be provided with special openings or fastening means for attaching or connecting real or artificial branches thereto (e.g. to the trunk portion 2), wherein said openings or fastening means are spaced from each other along a length of the trunk portion 2. In some examples, the branches 3 may be attached to the trunk portion 2 of the core support 6. When the Artificial tree 10 needs to be disassembled for packing and transporting the Artificial tree 10 from one installation place to another installation place, the trunk members (not shown) may be disconnected from each other in order to have disconnected trunk members ready to be packed, wherein the disconnected trunk members each have a length that is less than a few times the length of the trunk 2.

In some embodiments, the trunk portion 2 of the core support 6 can be disconnected from a bearing or supporting member 7 that may, e.g. join the base of the receptacle 1 to the trunk portion 2, e.g., for storage or transportation (e.g. by being placed in the receptacle 1). The trunk portion 2 may be composed of multiple trunk members forming the trunk of the artificial tree 10 that extends from the receptacle 1. Each of the trunk members may have one or more branches 3 connected or connectable thereto.

The trunk portion 2 may have an outer layer (not shown) covering a body of the trunk 2, wherein the outer layer may be, in the example, an artificial grass or the like, but could be any appropriate flexible material providing the general appearance of a real fir or pine.

As shown in FIG. 1, the trunk portion 2 is provided with a plurality of prefabricated artificial branches 3 that may be removably attached or connected to the trunk portion 2. In one embodiment of the present disclosure, the branches 3 may be real branches or a combination of real branches and prefabricated artificial branches. As described above, the branches 3 may be attached or connected to the trunk portion 2 by inserting thereof into corresponding openings (not shown) made in the trunk portion 2. In an embodiment of the present disclosure, the branches 3 may be fastened to the trunk portion 2 by using fastening means (not shown) provided in the trunk portion 2, wherein the fastening means may be grip elements, holders, latches, snaps, clamps or any other suitable fasteners known in the art. The branches 3 may be each formed of a plurality of branch elements integrally formed with each other or releasably attached or connected to each other in an appropriate manner to resemble branches of a real fir or pine. The branches 3 may be pliable (can be bent and retain their shape after bending) in order to shape the crown of the artificial tree 10.

When the Artificial tree 10 is to be disassembled for packing, for transporting the artificial tree 10 from one installation place to another installation place, the branches 3 may be disconnected from the trunk portion 2 in order to have disconnected branches ready to be packed. In some embodiments where the branches 3 are joined to the trunk portion 2, where the trunk portion 2 may be disassembled into its constituting trunk members (and the branch(es) joined to each of the trunk members) for the purpose of packing.

The artificial tree 10 may also have a bearing or supporting member 7 formed as a tube or a rod-shaped member, as part of the core support 6. The supporting member 7 is used for mounting the trunk portion 2 with the branches 3 connected thereto in the receptacle 1. In particular, the bottom of the receptacle 1 may be provided with a threaded lock nut 5 welded to a center of the bottom and provided with an internal or female thread (not shown), and opposite ends of the supporting member 7 are each provided with an external or male thread (not shown). Furthermore, the trunk portion 2 may have a threaded free end (not shown) which is opposite to a top of the artificial tree 10 and provided with an internal or female thread (not shown).

Figure 3:
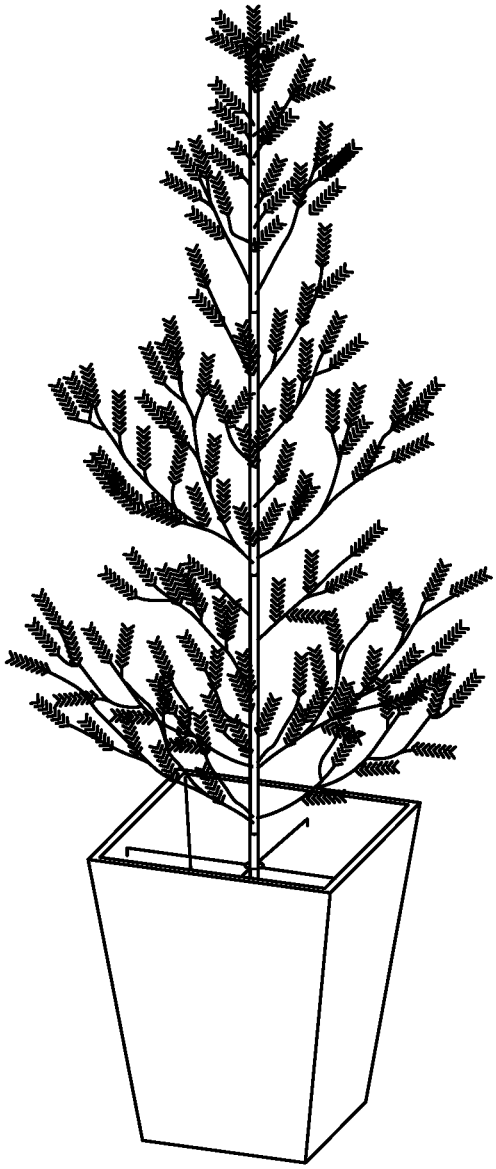
FIG. 3 illustrates the artificial tree in its fully assembled state.

Thus, in this example, when the artificial tree 10 is to be assembled, one threaded end of the supporting member 7 may be tightly screwed into the female thread of the lock nut 5 to provide a reliable connection between the supporting member 7 and the receptacle 1, and the trunk portion 2 may be tightly screwed onto the male thread of the other threaded end of the supporting member 7 to provide a reliable connection between the supporting member 7 and the trunk portion 2. Meanwhile, the supporting member 7 is screwed into lock nut 5 provided on the bottom of the receptacle 1 such that the supporting member 7 substantially axially extends from the bottom, and the trunk portion 2 is screwed onto the supporting member 7 such that the mounted trunk portion 2 is virtually an extension of the supporting member 7, the extension being coaxial with the supporting member 7. Furthermore, the supporting member 7 and the trunk portion 2, when interconnected and mounted in the hollow interior of the receptacle 1, extend both upwardly (e.g. in parallel to the sidewalls of the receptacle 1), wherein a total height of the supporting member 7 is less than or equal to that of the receptacle 1. In some examples, the supporting member 7 may extend from the hollow receptacle 1 (e.g. the supporting member 7 may be painted or decorated to resemble a tree trunk). In practice, as shown in FIG. 3, the trunk portion 2 is removably attached to a supporting member 7 such that the branches 3 extend outwardly from the receptacle 1 (i.e. the branches 3 are outside of the hollow interior of the receptacle 1). In some embodiments, some branches relating to a lower row of the branches 3 connected to the trunk portion 2 may partly extend in the hollow interior of the receptacle 1.

Figure 5:
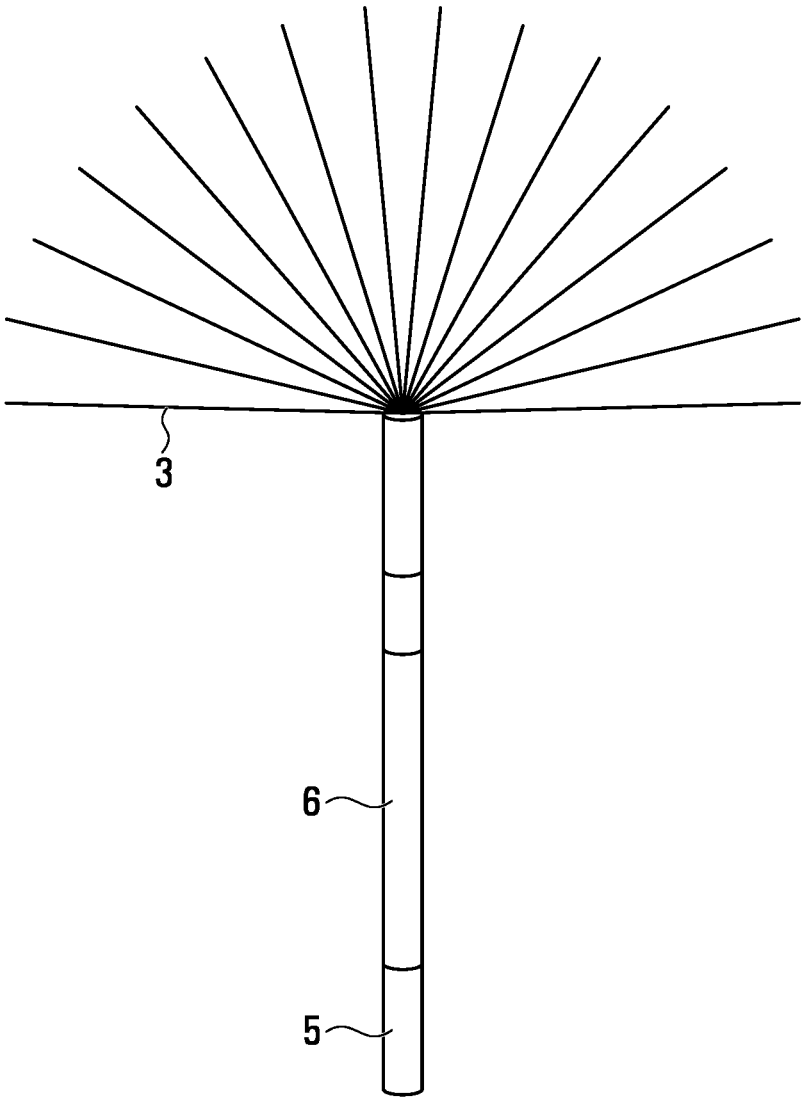
FIG. 5 illustrates an exemplary core support and branches connected to the top of the core support to form a smaller artificial tree, such as the one illustrated in FIG. 6.

In some examples, (e.g. for a small artificial tree), the core support 6 may only include a supporting member 7, having no trunk portion 2, where the branches may be connected to a top of the supporting member 7, as shown in FIG. 5 (where branches 3—joined to the rods—may be added to the top aperture of the core support 6).

In an embodiment, the bottom of the receptacle 1 may be provided with a threaded hole having an internal or female thread, so that one threaded end of the supporting member 7 may be screwed into the female thread of the bottom hollow interior (the base). In another embodiment, the bottom of the receptacle 1 may be provided with a slot designed to receive the supporting member 7, and one of the opposite ends of the supporting member 7 may be designed to be inserted into the bottom slot. In other embodiments, the bottom of the receptacle 1 may be provided with an axial rod or pin, and one of the opposite ends of the supporting member 7 may be provided with a recess or passage designed to receive the bottom pin, thereby forming a press-fit connection between the bottom pin and the supporting member 7. In some embodiments, the trunk portion 2 may be provided with a recess or passage designed to receive one end of the supporting member 7, thereby forming a press-fit connection between the trunk portion 2 and the supporting member 7.

In a particular embodiment, the supporting member 7 may be integral with the bottom of the receptacle 1. In one embodiment, the supporting member 7 may be welded to the bottom of the receptacle 1.

In various embodiments, the supporting member 7 may be coupled or secured to the bottom of the receptacle 1 by using any suitable clamps, locking mechanisms, snaps, or any means known in the art allowing the supporting member 7 to be removably attached to the bottom of the receptacle 1. In other embodiments, the supporting member 7 may be fastened to the bottom of the receptacle 1 by using any fastening means known in the art, including bolts, screws, studs, or any other means known in the art allowing the supporting member 7 to be removably fastened to the bottom of the receptacle 1. In some other embodiments, the supporting member 7 may be secured to sidewalls of the receptacle 1 and/or to the bottom of the receptacle 1 such that the supporting member 7 is fixed in the hollow interior of the receptacle 1 in a suitable manner.

It is to note that the above-described connections provided between the supporting member 7, the trunk portion 2 and the bottom of the receptacle 1 allow the supporting member 7 and the trunk portion 2 to be releasably fixed in the hollow interior of the receptacle 1, wherein the supporting member 7 and the trunk portion 2 are substantially positioned in a center or centralized in the hollow interior of the receptacle 1.

When the artificial tree 10 needs to be disassembled for packing and transporting the artificial tree 10 from one installation place to another installation place, the trunk portion 2 may be detached from the supporting member 7 (in particular, the trunk portion 2 may be unscrewed from the supporting member 7), and, if required, the supporting member 7 may be detached from the bottom of the receptacle 1 (in particular, the supporting member 7 may be unscrewed from the lock nut 5), so that there are the unscrewed trunk portion 2 and the unscrewed supporting member 7 ready to be packed.

As shown in FIG. 3, the hollow receptacle 1 of the artificial tree 10 may have a conical or pyramidal form.

Further, as shown in FIG. 1, the supporting member 7 generally formed as a rod-shaped member may be provided with a spacer 4 (e.g. disc-shaped; cross-shaped, etc.) releasably mounted thereon such that the spacer 4 at least partly closely bears against an inner surface of the receptacle sidewalls. In particular, the spacer 4 may be press-fitted onto the supporting member 7 when assembling the artificial tree 10. In an embodiment, any suitable fastening means known in the art may be used for securely mounting the spacer 4 on the supporting member 7. In other embodiments, the spacer 4 may be welded or fixed to the supporting member 7 and/or to the sidewalls of the receptacle 1. It is of note that the spacer 4 mounted on the supporting member 7 in the above-described manner stabilizes the trunk portion 2 and, therefore, the artificial tree 10, wherein the spacer 4 also facilitates centralization of the supporting member 7 with the trunk portion 2 attached thereto within the hollow receptacle of the receptacle 1. The spacer 4 may also act as a support to the trunk portion 2, acting as an obstacle that prevents the trunk portion 2 from sliding down into the receptacle 1, the trunk portion 2 weighed down by the branches 3 attached thereto (e.g. when the diameter of the trunk portion 2 is larger than the diameter of the rest of the core support 6 or its supporting member 7).

When the artificial tree 10 is to be disassembled for packing and transporting the artificial tree 10 from one installation place to another installation place, the spacer 4 may be demounted from the supporting member 7 to have the demounted spacer 4 ready to be packed. In one embodiment, the spacer 4 may be kept in place when a space as defined by the receptacle sidewalls and the spacer 4 in an upper part of the hollow interior of the receptacle is enough for receiving all the dissembled structural elements of the artificial tree 10.

Moreover, the hollow interior of the receptacle 1 is generally sized to accommodate the branches 3 (removed from or attached to the trunk portion 2) and, the core support 6 (in some embodiments, the trunk members disconnected from each other after detaching the trunk portion 2 from the supporting member 7). When the spacer 4 is removably mounted on the supporting member 7, the size of the hollow interior or the receptacle 1 may also allow the removed spacer 4 to be placed in the hollow interior of the receptacle 1 together with the removed branches 3 and the disconnected trunk members.

Figure 4:
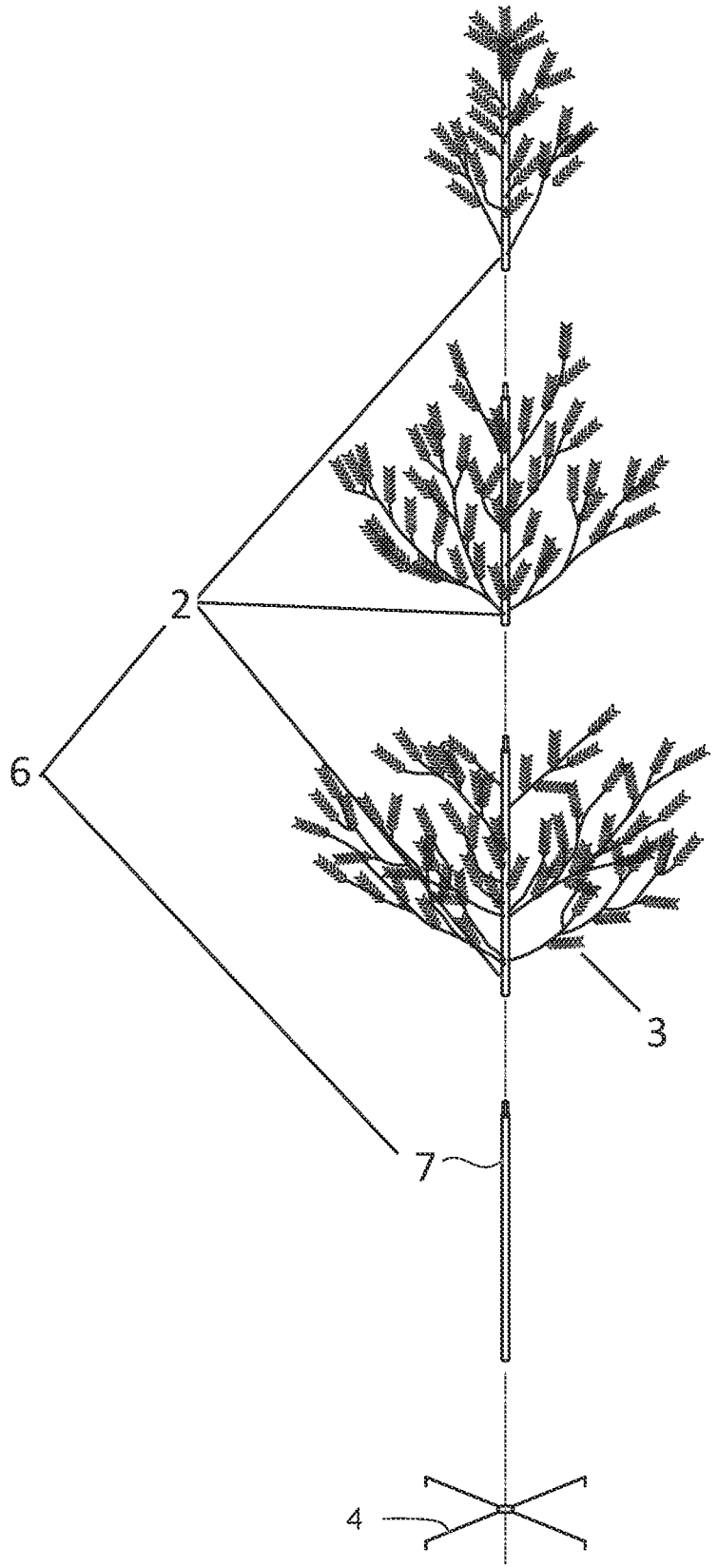
FIG. 4 illustrates exemplary trunk sections with branches connected thereto.

The branches 3 may be connected to the core support 6 (e.g. trunk portion 2 of the core support 6) through one or more intermediary connectors. Intermediary connectors may be interspersed periodically along the length of the trunk portion 2, in order to receive branches 3 and to yield a full crown for the artificial tree 10. The intermediary connector may have one or more thin arms for receiving the branches 3. For instance, each arm of the intermediary connector may be thin enough to fit into a hollow space defined by a tube (e.g. metal tube) of a branch 3, where the needles and/or leaves may be joined to the tube. An intermediary connector may have a cross shape as illustrated in the example of FIG. 4 (with four arms). However, it will be appreciated that the number of arms of the intermediary connector may vary (e.g. depending on the number of branches 3 joined thereto).

It will be understood that other ways of connecting the branch(es) 3 to the intermediary connector, such as a fastener (an elastic; a tie wrap; a screw; etc.) may be used without departing from the present teachings, where the intermediary connector may be dimensioned as a function of the characteristic of the branches 3 (e.g. can have multiple one or more tubular arms where instead the branch 3 fits into the space defined by the tubular arm of the intermediary connector). In the present disclosure, when it is referred to branches 3 connected to the core support 6 (or vice versa), this refers to embodiments with or without intermediary connectors.

In some examples, as shown in FIG. 4, the branches 3 may be permanently connected to the core support 6 (or trunk segments of the trunk portion 2 as in FIG. 4), where the branches cannot be manually disconnected from the trunk segments or the core support 6.

In an embodiment, in case when the spacer 4 is fixedly mounted on or fixed to the supporting member 7, an upper part of the hollow interior of the receptacle as defined by the receptacle sidewalls and the spacer 4 may be sized to accommodate the branches 3 removed from the trunk portion 2 and the trunk members disconnected from each other after detaching the trunk portion 2 from the supporting member 7.

In some embodiments, the spacer 4 may be provided with holes (not shown) sized and shaped to accommodate the branches 3 removed from the tree trunk 4 and holes (not shown) sized and shaped to accommodate the trunk members disconnected from each other, wherein the holes made in the spacer 4 may have the same sizes and forms or different sizes and forms allowing the removed branches 3 and the disconnected trunk members to be inserted thereinto.

In some other embodiments, the hollow interior of the receptacle 1 may be provided with holders (not shown) for holding branches 3 removed from the trunk portion 2 and the trunk members disconnected from each other after detaching the trunk portion 2 from the supporting member 7. In particular, the holders may be secured to sidewalls of the receptacle 1 such that they form groups positioned within the hollow interior at different levels each corresponding to a particular height of the receptacle 1, and the holders relating to a particular group are circumferentially spaced from each other at a height level corresponding to the group.

In a particular embodiment, the receptacle 1 may be further provided with a hinged lid or cap used to close an open end of the receptacle 1 when the artificial tree 10 needs to be transported, thereby protecting the content placed inside the hollow interior of the receptacle 1. In particular, the cap is configured to be opened when the tree structural elements are to be taken out the hollow interior of the receptacle 1 and assembled with each other in an appropriate manner to form the artificial tree 10. Also, cap is configured to be closed when the dissembled structural elements of the artificial tree 10 are packed inside the hollow interior of the receptacle 1 to have the artificial tree 10 ready for transportation.

Figure 2:
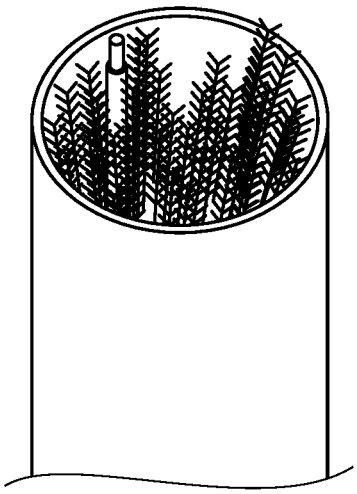
FIG. 2 illustrates the artificial tree in its disassembled state.

Generally, when a user needs to assemble the artificial tree 10 transported in a disassembled state shown in FIG. 2 to an intended installation place, the user needs to unpack or remove a package containing the disassembled artificial tree 10, the package containing the receptacle 1 with the other components of the artificial tree 10 contained therein. Then the user retrieves the dissembled structural elements of the artificial tree 10 from the hollow interior of the receptacle 1, in particular the user takes separate branches 3 and the trunk or separate trunk members (not shown) out of the hollow interior of the receptacle 1. Next, the user may interconnect the trunk members to form the trunk portion 2 and connect the branches 3 to the formed trunk portion 2 to form a crown-containing part of the artificial tree 10. Finally, the user mounts the crown-containing part of the artificial tree 10 inside the hollow interior of the receptacle 1 by attaching the trunk portion 2 provided with the branches 3 to the supporting member 7 which is generally fixed in the hollow interior. However, if the supporting member 7 is placed in the hollow interior of the receptacle 1 as one of the dissembled structural elements of the artificial tree 10, the user takes the supporting member 7 out the hollow interior of the receptacle 1 and secures the supporting member 7 to the bottom of the receptacle 1 before the trunk portion 2 provided with the branches 3 is attached to the supporting member 7. If the spacer 4 is also placed in the hollow interior of the receptacle 1 as one of the dissembled structural elements of the artificial tree 10 (i.e. the supporting member 7 is not originally provided with the spacer 4 secured to the supporting member 7), the user may take the spacer 4 out the hollow interior of the receptacle 1 and mounts the spacer 4 on the supporting member 7 and secures the supporting member 7 provided with the spacer 4 mounted thereon to the bottom of the receptacle 1.

Generally, when a user disassembles the artificial tree 10 having an assembled state shown in FIG. 3 for storage, packing, shipping and/or to simply move the Artificial tree 10 around a space (e.g. the artificial tree 10 from one installation moved to another installation place), the user performs one or more of the following actions or steps: (i) removing the branches 3 from the trunk portion 2; (ii) detaching the trunk portion 2 from the supporting member 7; (iii) disconnecting the trunk members of the detached trunk portion 2 from each other. The user then places the removed branches 3 and the disconnected trunk members (or trunk portion 2) inside the hollow interior of the receptacle 1, wherein the hollow interior is sized to accommodate the removed branches 3 and the disconnected trunk members (or trunk). It is to note that the step (ii) may be performed by the user before or after step (i) is performed. It is to further note that the supporting member 7 and the spacer 4 mounted thereon may be left fixed within the hollow interior of the receptacle 1 if a space defined by the spacer 4 and the sidewalls of the receptacle 1 is enough to receive the removed branches 3 and the disconnected trunk members to be placed inside the hollow interior.

In an embodiment of the above-described method of packing the artificial tree 10 to be transported, in an example where the spacer 4 is releasably mounted on the supporting member 7 and has to be demounted to provide enough space for receiving the branches 3 to be removed from the trunk portion 2 and the trunk members to be disconnected from each other, the user performs at least one or more of the following actions or steps: (i) removing the branches 3 from the trunk portion 2; (ii) detaching the trunk portion 2 from the supporting member 7; (iii) disconnecting the trunk members of the detached trunk portion 2 from each other; (iv) dismounting the spacer 4 from the supporting member 7 formed as a rod-shaped member. The user then places the removed branches 3, the disconnected trunk members (or trunk) and the demounted spacer 4 inside the hollow interior of the receptacle 1, wherein the hollow interior is adapted to accommodate the removed branches 3, the disconnected trunk members and the demounted spacer 4.

In another embodiment of the above-described method of packing the artificial tree 10 to be transported, where the spacer 4 is releasably mounted on the supporting member 7, and the supporting member 7 is releasably secured to the bottom of the receptacle 1, and the supporting member 7 and the spacer 4 are to be removed to provide enough space for receiving the branches 3 to be removed from the trunk portion 2 and the trunk members to be disconnected from each other, the user perform at least one or more of the following actions or steps: (i) removing the branches 3 from the trunk portion 2; (ii) detaching the trunk portion 2 from the supporting member 7; (iii) disconnecting the trunk members of the detached trunk portion 2 from each other; (iv) dismounting the spacer 4 from the supporting member 7 formed as a rod-shaped member; (v) detaching the supporting member 7 from the bottom of the receptacle 1. The user places the removed branches 3, the disconnected trunk members (or trunk), the demounted spacer 4, and the detached supporting member 7 inside the hollow interior of the receptacle 1, wherein the hollow interior is adapted to accommodate removed branches 3, the disconnected trunk members, the demounted spacer 4, and the detached supporting member 7.

In other embodiments of the above-described method of packing the artificial tree 10 to be transported, in an example when the spacer 4 is provided with holes, the user performs at least one or more of the following actions or steps: (i) removing the branches 3 from the trunk portion 2; (ii) detaching the trunk portion 2 from the supporting member 7; (iii) disconnecting the trunk members of the detached trunk portion 2 from each other; and (iv) inserting the removed branches 3 and the disconnected trunk members into corresponding holes of the spacer 4 mounted on the supporting member 7.

In some other embodiments of the above-described method of packing the Artificial tree 10 to be transported, when the hollow interior of the receptacle 1 is provided with holders, the user performs at least the following actions or steps: (i) removing the branches 3 from the trunk portion 2; (ii) detaching the trunk portion 2 from the supporting member 7; (iii) disconnecting the trunk members of the detached trunk portion 2 from each other; (iv) holding the removed branches 3 and the disconnected trunk members with corresponding holders of the receptacle 1.

Figure 6:
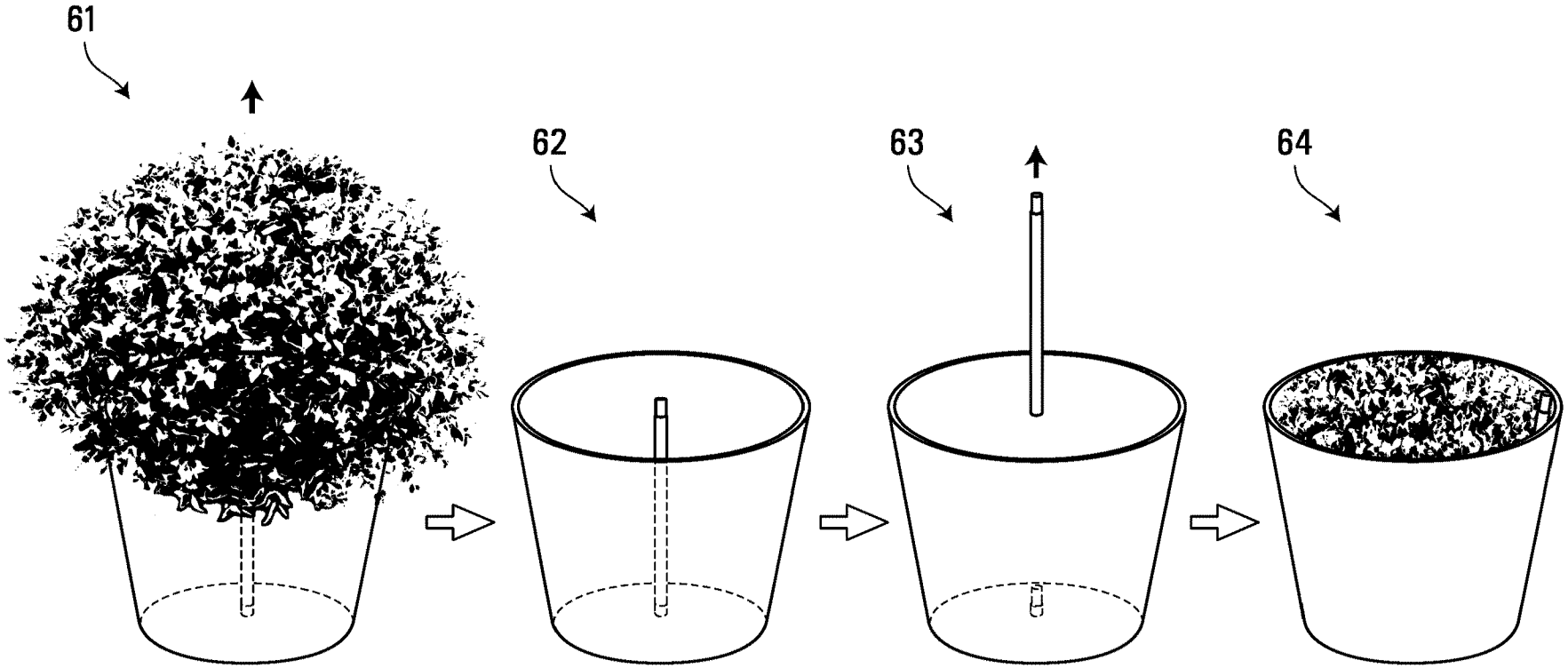
FIG. 6 illustrates an exemplary set of steps for disassembling an exemplary small artificial tree.

Reference is now made to FIG. 6, illustrating an exemplary set of steps for disassembling a small artificial tree. Reference is made to artificial tree 10, however it will be understood that any artificial tree in accordance with the present teachings may be used.

The branches 3 of the artificial tree 10 may be removed from the core support 6 at step 61. An intermediary component may connect the branches 3 to the core support 6, such as the elongated thin rods fitting into the top of the core support 6. In some examples, the branches 3 may be permanently connected to the core support 6.

Optionally, trunk members of the trunk 2 may be removed from the supporting member 7 of the core support 6 at step 62. The branches 3 may be attached to the trunk members.

Optionally, the core support 6 or the remainder from the core support 6 (e.g. supporting member 7) may be removed from the base of the receptacle (e.g. lock nut 5) at step 63.

The disassembled components of the artificial tree 10 (e.g. branches 3; trunk members or trunk portion 2; the supporting member 7), other that the receptacle 1, are added to the hollow interior of the receptacle 1 at step 64. The disassembled tree 10 occupies a smaller space than when assembled, defined by the dimensions of receptacle 1, the disassembled artificial tree 10 ready for the purpose of packing (e.g. storage and/or transportation).

Figure 7:
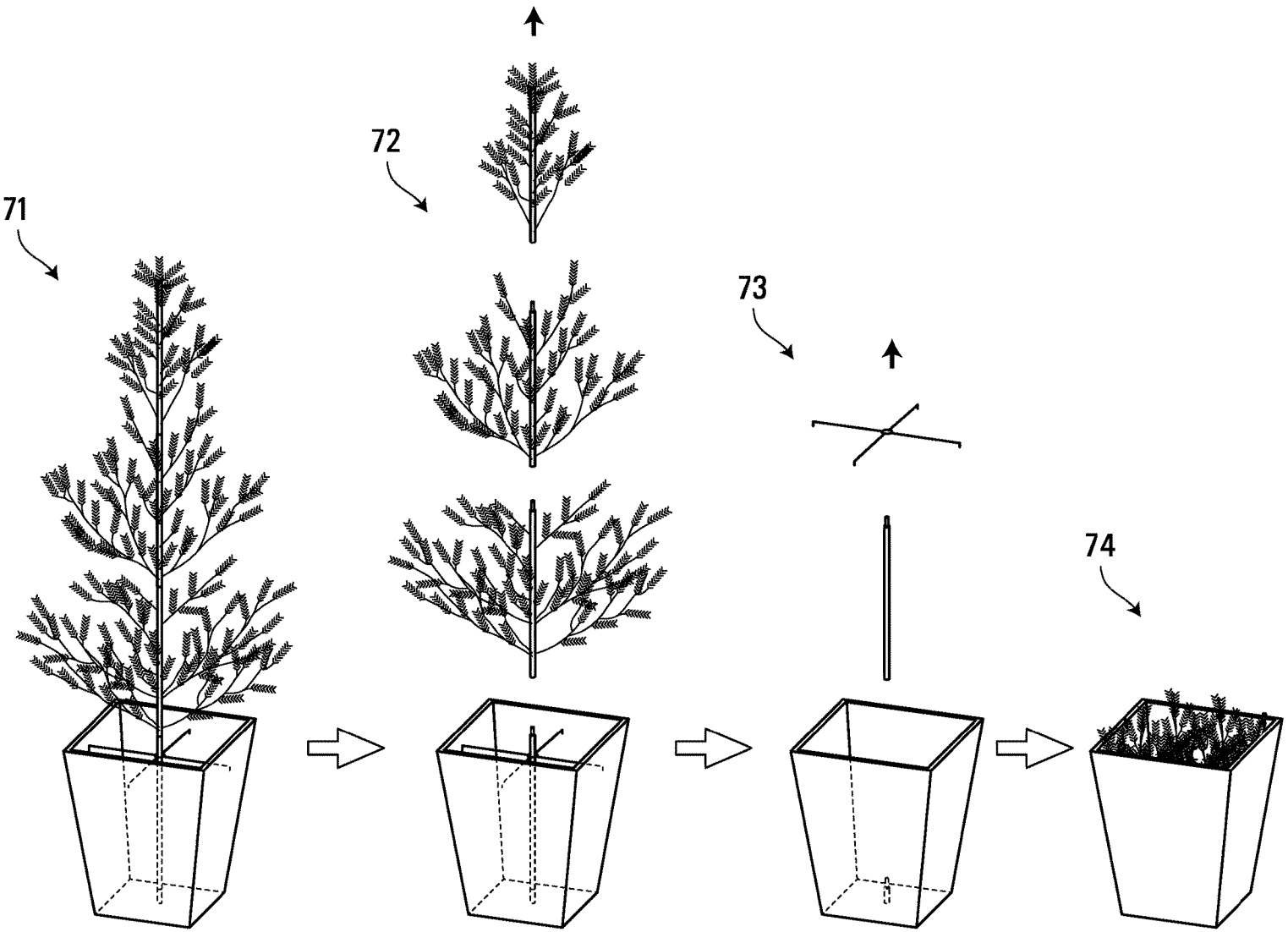
FIG. 7 illustrates an exemplary set of steps for disassembling an exemplary large artificial tree.

Reference is now made to FIG. 7, illustrating an exemplary set of steps for disassembling a large artificial tree. Reference is made to artificial tree 10, however it will be understood that any artificial tree in accordance with the present teachings may be used.

The branches 3 may be removed from the core support 6 (e.g. the trunk portion 2) at step 71. In some embodiments, the branches 3 are connected to the core support 6 through an intermediary connector, such as the wire cross illustrated in the image of step 72. When the core support 6 includes trunk segments, the trunk segments may be disassembled at step 71. The intermediary connectors for receiving the branches 3 may be also be removed from the core support, resulting in the disassembled artificial tree components of step 72. In some embodiments, as shown in FIG. 7, the branches 3 may be permanently connected to the core support, e.g., the trunk segments, where the trunk segments are disassembled to fit into the hollow interior of the receptacle 1.

The remainder of the core support 6 (i.e. in the example of FIG. 7, the supporting member 7) is disconnected from the base of the receptacle 1 (e.g. lock nut 5) at step 73.

The disassembled components of the artificial tree 10 (e.g. the branches 3; the intermediary connectors; the core support 6—such as the trunk segments, the supporting member; the spacer, etc.), other than the receptacle 1, are placed in the hollow interior of receptacle 1 at step 74. The disassembled artificial tree 10 now fits into the receptacle 1 and its dimensions are defined by the receptacle 1, thereby being significantly more compact that the larger dimensions of the fully assembled artificial tree 1. The disassembled artificial tree 10 may now be packed (e.g. stored and/or shipped).

Although the invention has been described with reference to preferred embodiments, it is to be understood that modifications may be resorted to as will be apparent to those skilled in the art. Such modifications and variations are to be considered within the purview and scope of the present invention.

Representative, non-limiting examples of the present invention were described above in detail with reference to the attached drawing. This detailed description is merely intended to teach a person of skill in the art further details for practicing preferred aspects of the present teachings and is not intended to limit the scope of the invention. Furthermore, each of the additional features and teachings disclosed above and below may be utilized separately or in conjunction with other features and teachings.

Moreover, combinations of features and steps disclosed in the above detailed description, as well as in the experimental examples, may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

What is claimed is:

1. A modular artificial tree decoration comprising:

a pot defining a hollow receptacle reaching a base of the pot;

a core support comprising:

detachable members that assemble into a trunk; and a rod-shaped supporting member for mounting the detachable members forming the trunk to the base of the pot with a diameter that is different from a diameter of a detachable member of the detachable members that connects with the rod-shaped supporting member;

branches connected or connectable to the detachable members of the core support; and a spacer configured to fit around the rod-shaped supporting member to center the core support with respect to the hollow receptacle, to bear against an inner surface of the pot and that is dimensioned to act as an obstacle that prevents the detachable members from sliding down into the hollow receptacle due to the diameter of a detachable member of the detachable members that connects with the rod-shaped supporting member being different from the diameter of the rod-shaped supporting member;

wherein the rod-shaped supporting member connects within the hollow receptacle to the base of the pot and the detachable members are attachable to one another, and fitted to the rod-shaped supporting member to extend upwardly from the pot and to form the trunk with the branches extending from the trunk, the spacer bearing within the hollow receptacle against an inner surface of the pot and preventing the detachable members forming the trunk from sliding down into the hollow receptacle due to the diameter of the detachable member of the detachable members that connects with the rod-shaped supporting member being different from the diameter of the rod-shaped supporting member; and wherein the detachable members of the core support are configured to detach from one another and from the supporting member and to be stored, with the branches, in the hollow receptacle of the pot, the pot dimensioned to receive and contain the detached detachable members, the supporting member, the spacer and the branches, for at least one of storage and transportation of the modular artificial tree decoration that is disassembled.

2. The modular artificial tree decoration as defined in claim 1 wherein one of:

the branches are permanently connected to the core support and the core support is composed of a plurality of segments; and the branches are connectable to the core support during assembly of the artificial tree and can be disconnected from the core support during disassembly of the modular artificial tree decoration.

3. The modular artificial tree decoration as defined in claim 1, wherein the spacer is disk-shaped.

4. The modular artificial tree decoration as defined in claim 1, wherein the branches are pliable in order to be adapted a shape of a crown of the modular artificial tree decoration.

5. A method of packing the modular artificial tree decoration as defined in claim 1, comprising:

detaching the detachable members, connected or connectable to branches of the modular artificial tree decoration, from the rod-shaped supporting member;

detaching the detachable members from one another;

placing the detached detachable members of the core support and the branches, connected to the detachable members or disconnected from the detachable members, inside the hollow receptacle with the spacer and the rod-shaped supporting member for at least one of storage and transportation; and placing a lid onto the pot to close the hollow receptacle.

6. A method of unpacking and assembling a modular artificial tree decoration for display, comprising:

opening a lid from a pot acting as a vessel for storage, revealing a hollow receptacle of the pot;

from the hollow receptacle of the pot, removing a spacer, detachable members of a core support and branches;

fitting the spacer onto a rod-shaped supporting member connected to a base of the pot while the spacer bears on an inner wall of the pot;

connecting the detachable members of the core support, with the branches connected to the detachable members of the core support, together to form a trunk; and fitting the connected detachable members onto the rod-shaped supporting member where the spacer acts as an obstacle that prevents the detachable members from sliding down into the hollow receptacle due to the diameter of a detachable member of the detachable members that connects with the rod-shaped supporting member being different from the diameter of the rod-shaped supporting member, and the detachable member connected to a base of the pot.

7. The modular artificial tree decoration as defined in claim 1, wherein the spacer, that is dimensioned to act as an obstacle that prevents the detachable members from sliding down into the hollow receptacle due to the diameter of a detachable member of the detachable members that connects with the rod-shaped supporting member being different from the diameter of the rod-shaped supporting member, is cross-shaped.

8. The modular artificial tree decoration as defined in claim 1, wherein the base of the pot comprises a slot configured to receive the rod-shaped supporting member at a first end, the detachable members configured to connect to the rod-shaped supporting member at a second end of the rod-shaped supporting member opposite the first end.

9. The modular artificial tree decoration as defined in claim 1, wherein the branches are connected to the detachable members, and the spacer is provided with spacing or holes configured to accommodate the branches that are connected to the detachable members and received within the hollow receptacle with the spacer contained therein.

10. A modular artificial tree decoration comprising:

a pot defining a hollow receptacle reaching a base of the pot;

a core support comprising:

detachable members that assemble into a trunk; and a rod-shaped supporting member for mounting the detachable members forming the trunk to the base of the pot;

branches connected to the detachable members of the core support; and a spacer configured to fit around the rod-shaped supporting member to center the core support with respect to the hollow receptacle, to bear against an inner surface of the pot and that is dimensioned with spaces or openings to accommodate the detachable members with the branches once received within the hollow receptacle with the spacer contained therein;

wherein the rod-shaped supporting member connects within the hollow receptacle to the base of the pot and the detachable members are attachable to one another, and fitted to the rod-shaped supporting member to extend upwardly from the pot and to form the trunk with the branches extending from the trunk, the spacer bearing within the hollow receptacle against an inner surface of the pot to center the supporting member with respect to the pot; and wherein the detachable members of the core support are configured to detach from one another and from the supporting member and to be stored, with the branches, in the hollow receptacle of the pot, the pot dimensioned to receive and contain the detached detachable members, the supporting member, the spacer and the branches, the spaces or openings of the spacer accommodating the detachable members with the branches placed within the hollow receptacle, for at least one of storage and transportation of the modular artificial tree decoration that is disassembled.

* * * * *